US012371826B2

(12) United States Patent
Izawa

(10) Patent No.: US 12,371,826 B2
(45) Date of Patent: Jul. 29, 2025

(54) TOWELING AND MANUFACTURING METHOD THEREOF

(71) Applicant: IZAWA TOWEL CO., LTD., Tokyo (JP)

(72) Inventor: Shoji Izawa, Tokyo (JP)

(73) Assignee: IZAWA TOWEL CO. LTD., Tokyo (JP)

( * ) Notice: Subject to any disclaimer, the term of this patent is extended or adjusted under 35 U.S.C. 154(b) by 0 days.

(21) Appl. No.: 17/915,004

(22) PCT Filed: Sep. 1, 2021

(86) PCT No.: PCT/JP2021/032142
§ 371 (c)(1),
(2) Date: Sep. 27, 2022

(87) PCT Pub. No.: WO2022/059487
PCT Pub. Date: Mar. 24, 2022

(65) Prior Publication Data

US 2023/0203723 A1 Jun. 29, 2023

(30) Foreign Application Priority Data

Sep. 15, 2020 (JP) ..... 2020-154560

(51) Int. Cl.
*D03D 27/08* (2006.01)
*D03D 1/00* (2006.01)
(Continued)

(52) U.S. Cl.
CPC ..... *D03D 27/08* (2013.01); *D03D 1/0017* (2013.01); *D03D 13/008* (2013.01);
(Continued)

(58) Field of Classification Search
CPC .... D03D 27/08; D03D 1/0017; D03D 13/008; D03D 15/217; D03D 15/47; D03D 15/49;
(Continued)

(56) References Cited

U.S. PATENT DOCUMENTS 2,890,567 A * 6/1959 Taylor ..... B60C 9/0042 28/240
3,070,950 A * 1/1963 Thomas ..... D02G 3/367 57/12
(Continued)

FOREIGN PATENT DOCUMENTS

JP S 51012747 U 1/1976
JP S 53098442 A 8/1978
(Continued)

OTHER PUBLICATIONS

Notice of Reasons for Refusal from priority Japanese patent application No. 2020-154560, dated Jun. 11, 2021, and machine translation, 8 pages.
(Continued)

*Primary Examiner* — Robert H Muromoto, Jr.
(74) *Attorney, Agent, or Firm* — Sterne, Kessler, Goldstein & Fox P.L.L.C.

(57) ABSTRACT

To provide towel cloth which has favorable pile uprightness, erectility of pile, and bulkiness, and has both a fluffy hand and a dry touch, and moreover which hardly drops fluff, and a manufacturing method of such towel cloth. Towel cloth constituted by locking a pile yarn to a ground yarn, wherein the pile yarn has two or more single yarns which are initially twisted in a same direction and which are subsequently twisted in an opposite direction to the initial twist.

8 Claims, 4 Drawing Sheets

(51) Int. Cl.

| | |
|---|---|
| ***D03D 13/00*** | (2006.01) |
| ***D03D 15/217*** | (2021.01) |
| ***D03D 15/47*** | (2021.01) |
| ***D03D 15/49*** | (2021.01) |

(52) U.S. Cl.
CPC ..... *D03D 15/217* (2021.01); *D03D 15/47* (2021.01); *D03D 15/49* (2021.01); *D10B 2401/00* (2013.01)

(58) Field of Classification Search
CPC .. D10B 2401/00; D10B 2201/02; D02G 3/28; A47K 10/02
See application file for complete search history.

(56) References Cited

U.S. PATENT DOCUMENTS

| | | | | | |
|---|---|---|---|---|---|
| 4,559,772 | A * | 12/1985 | Heinrich | D02G 1/0206 | 57/247 |
| 4,726,400 | A * | 2/1988 | Heiman | D03D 27/08 | 139/396 |
| 5,014,360 | A * | 5/1991 | Smith | A41D 13/0015 | 2/125 |
| 5,030,500 | A * | 7/1991 | Perdelwitz, Jr. | B29C 66/7294 | 428/137 |
| 5,091,102 | A * | 2/1992 | Sheridan | C11D 17/049 | 424/404 |
| 5,702,992 | A * | 12/1997 | Martin | A47K 7/03 | 428/36.2 |
| 6,546,965 | B2 * | 4/2003 | Hamby | D03D 27/08 | 139/420 A |
| 6,722,117 | B2 * | 4/2004 | Belcher, Jr. | D02G 1/20 | 57/244 |
| 7,000,729 | B2 * | 2/2006 | Jacobsen | E04B 1/84 | 181/290 |
| 8,877,316 | B2 * | 11/2014 | Hasenoehrl | A61F 13/51113 | 428/137 |
| 9,885,127 | B2 * | 2/2018 | Lightman | D01G 21/00 | |
| 10,072,364 | B2 | 9/2018 | Goenka | | |
| 10,196,764 | B2 * | 2/2019 | Asano | D02G 3/406 | |
| 11,257,047 | B2 * | 2/2022 | Nunn | G06Q 10/30 | |
| 2002/0029554 | A1 * | 3/2002 | Belcher, Jr. | D02G 3/28 | 57/333 |
| 2004/0055659 | A1 * | 3/2004 | Hugh Silver | A47K 10/02 | 139/396 |
| 2004/0065507 | A1 * | 4/2004 | Jacobsen | E04B 1/84 | 181/290 |
| 2007/0087162 | A1 * | 4/2007 | Mandawewala | D02G 3/36 | 428/95 |
| 2010/0282359 | A1 * | 11/2010 | Rabin | D03D 15/283 | 139/420 R |
| 2011/0016841 | A1 * | 1/2011 | Popper | D02G 3/286 | 57/204 |
| 2013/0042380 | A1 * | 2/2013 | Goodman | A41D 31/125 | 2/69 |
| 2015/0068000 | A1 * | 3/2015 | Asano | D02G 3/40 | 28/168 |
| 2016/0002829 | A1 * | 1/2016 | Lightman | D04H 1/04 | 19/65 R |
| 2018/0080151 | A1 * | 3/2018 | Goenka | D03D 1/0017 | |
| 2019/0257011 | A1 | 8/2019 | Goenka et al. | | |

FOREIGN PATENT DOCUMENTS

| | | | |
|---|---|---|---|
| JP | S 53111164 | A | 9/1978 |
| JP | 60-89289 | | 6/1985 |
| JP | H 08013283 | A | 1/1996 |
| JP | 2005015940 | A * | 1/2005 |
| JP | 2005042281 | A | 2/2005 |
| JP | 4393357 | B2 | 1/2010 |
| JP | 2014025173 | A | 2/2014 |
| JP | 2014101619 | A | 6/2014 |
| JP | 2016220807 | A | 12/2016 |

OTHER PUBLICATIONS

Decision to Grant from priority Japanese patent application No. 2020-154560, dated Oct. 13, 2021, and machine translation, 5 pages.

* cited by examiner

TOWELING AND MANUFACTURING METHOD THEREOF

TECHNICAL FIELD

The present invention relates to towel cloth and a manufacturing method thereof and, more specifically, to towel cloth which has favorable pile uprightness (erectility of pile) and bulkiness, and has both a fluffy hand and a dry touch, and moreover which hardly drops fluff, and to a manufacturing method of such towel cloth.

BACKGROUND ART

In recent years, with diversifying needs of consumers, there have been growing demands toward hand and high functionality of towels. Among such demands, with respect to hand, there is a great need for towels with a so-called luxurious feel that is attributable to bulkiness and fluffy hand regardless of whether the towels are thin or thick. While there are towels that use, for example, cotton or the like with high fineness, of which single filament fineness is in the vicinity of 1 denier, as an attempt to pursue such a fluffy feel, such towels are poor in terms of repulsion despite providing a soft feel, hence bulky towels are hardly produced. In addition, since wiping off moisture with a non-bulky towel when sweating or after a hot bath is often an unpleasant experience, due to a flat and sticky texture thereof, dry hand is desired. On the other hand, with respect to functionality, towels have a problem of drop fluff attaches to other clothing during washing or when being worn, which may create a poor appearance and a solution thereof is desired. Therefore, there are demands for towel cloth or the like with bulkiness, having both a fluffy hand and a dry touch, and which hardly drops fluff.

In consideration of the problem described above, various twisting methods using ring spun yarn which has become mainstream from a technical perspective are proposed. First, as a method of imparting bulkiness, a method is proposed in which a single spun yarn and a water-soluble yarn are twisted together, the doubled and twisted yarn is untwisted in a direction opposite to the original twist of the spun yarn and made into a woven/knitted fabric, and the water-soluble yarn is subsequently removed by dissolving (Patent Document 1). In addition, processing of spun yarn is proposed in which, without using the water-soluble yarn in order to reduce cost, spun single yarn is sized and dried and, subsequently, untwisted in a direction opposite to the spun yarn (Patent Document 2). Furthermore, in order to obtain a knitted fabric with a beautiful mesh texture, a synthetic hard twist-like textured yarn is proposed in which a single yarn is continuously fused in a state where an S-twist and a Z-twist are alternately twisted along a yarn axis (Patent Document 3). In addition, a twisted union yarn is proposed in which, in order to obtain hand with a cool contact feeling, when conjugating a natural or synthetic spun single yarn and a thermoplastic conjugate multifilament yarn, the filament yarn is false-twisted and crimped in a direction opposite to the spun single yarn, and the yarn is conjugated and then twisted in a same direction as the spun single yarn (Patent Document 4).

On the other hand, with respect to air spinning yarn, a brushed blanket using two ply yarn of air spinning yarn as a weft is proposed in order to suppress a rate of drop fluff due to brushing (Patent Document 5). In addition, with respect to air spinning yarn, a towel product is proposed in which spun yarns are arranged so that 20 to 30% of center portions of the yarns are parallel fiber portions to create an effect of water absorbability, hand, and suppression of drop fluff (Patent Document 6).

CITATION LIST

Patent Document

Patent Document 1: Japanese Patent No. 4393357
Patent Document 2: Patent Publication JP-A-2014-25173
Patent Document 3: Patent Publication JP-A-S53-98442
Patent Document 4: Utility Model Publication JP-A-S51-12747
Patent Document 5: Patent Publication JP-A-S53-111164
Patent Document 6: Patent Publication JP-A-2016-220807

Non-Patent Document

Non-Patent Document 1: Journal of Textile Engineering (2014), Vol. 60, No. 6, 91-98, Relation between Hand of Bath Towel and Physical properties Summary

Technical Problem

However, among these twisting methods, since water-soluble yarn is removed by dissolving in the invention disclosed in Patent Document 1, the invention disclosed in Patent Document 1 involves untwisting spun single yarn which is not substantially dissolved and therefore differs from the present invention. The invention disclosed in Patent Document 2 also involves untwisting single yarn after sizing and therefore differs from the present invention. The invention disclosed in Patent Document 3 is yarn in which an S-twist and a Z-twist are alternately present in a lengthwise direction of a single yarn and therefore differs from the present invention. The invention disclosed in Patent Document 4 involves eventually applying a twist in a same direction as spun yarn of a natural fiber or a synthetic fiber and does not correspond to the present invention.

In addition, among methods related to air spinning yarn, since the invention disclosed in Patent Document 5 simply uses two ply yarn of air spinning yarn as a weft and is not a twisting method which involves untwisting in a reverse direction, the invention differs from the present invention. While the invention disclosed in Patent Document 6 is most relevant in terms of air spinning yarn, the invention simply uses the spun yarn without any modification and differs from the method according to the present invention in which two or more spun yarns are aligned in parallel and then untwisted in a reverse direction. Furthermore, features including obtained bulkiness, fluffy hand, dry to the touch, and the feature of hardly dropping fluff are not quantitatively specified and produced effects are insufficient (described as a comparative example of the present invention).

As described above, under the present circumstances, none of the Patent Documents clearly represent towel cloth which has favorable pile uprightness (erectility of pile) and bulkiness, and has both a fluffy hand and a dry touch, and moreover which hardly drops fluff.

Physical properties for evaluating hand with a fluffy feel being directly related to bulkiness, which is required of towels, will now be described. Although the fluffy feel when using a towel is often experienced with pleasure as a luxurious feel, an evaluation of the fluffy feel was a sensory evaluation by a person (an evaluator) to date. It is said that, based on a relationship between hand evaluation and physical quantities, a fluffy feel has a strong correlation with compression workload (WC) (gf·cm$^2$) and is preferably expressed by this (Non-Patent Document 1, pages 96 to 98). In other words, the higher the compression workload (energy) when a load is applied to towel cloth, the more readily the towel is compressed and also the greater a bulge=fluffy feel. As will be described later, this will be applied to evaluations according to examples of the present invention.

An object of the present invention is to provide towel cloth which has favorable pile uprightness (erectility of pile) and bulkiness, and has both a fluffy hand and a dry touch, and moreover which hardly drops fluff, and a manufacturing method of such towel cloth.

Solution to Problem

In order to solve the problem described above, an aspect of towel cloth according to the present invention is:

towel cloth constituted by locking a pile yarn to a ground yarn, wherein the pile yarn has two or more single yarns initially twisted in a same direction, and in the pile yarn, the two or more single yarns are subsequently twisted in an opposite direction to the initial twist.

Having the single yarn constituted of an air spinning yarn further enhances pile uprightness (erectility of pile) and produces more bulky towel cloth as compared to a case not including the present configuration and is therefore preferable.

Adopting 8 to 120 as a yarn count of the single yarn enables the single yarn to be preferably used as towel cloth.

Constituting the single yarn so as to have a mixing ratio of cotton of 60 wt. % or higher enables the single yarn to satisfy hand, water absorbability, and moisture absorbency of cotton and is therefore preferable.

Adopting 100 to 1000 g/m$^2$ as weight enables effects of hand and drop fluff property to be exhibited and is therefore preferable.

In order to solve the problem described above, an aspect of a manufacturing method of towel cloth according to the present invention is a manufacturing method of towel cloth constituted by locking a pile yarn to a ground yarn, the method including:

a step of paralleling two or more single yarns initially twisted in a same direction;

a step of untwisting the two or more single yarns by a subsequent twist in an opposite direction to the initial twist and forming a pile yarn; and a step of locking the pile yarn to a ground yarn in which a warp ground yarn and a weft ground yarn intersect each other.

Advantageous Effects of Invention

According to the present invention, towel cloth which has favorable pile uprightness (erectility of pile) and bulkiness, and has both a fluffy hand and a dry touch, and moreover which hardly drops fluff, and a manufacturing method of such towel cloth can be provided.

DESCRIPTION OF EMBODIMENTS

Hereinafter, with reference to the photographs shown in FIG. 1, a first embodiment (a model test) using a thick string with respect to the twisting technique according to the present invention will be explained together with a manufacturing method thereof. A twisted yarn according to the first embodiment is manufactured by, for example, paralleling two or more single spun yarns having been initially twisted in a Z direction. While the number of yarns to be aligned in parallel is not limited as long as there are two or more, aligning two yarns in parallel is particularly preferable from the perspectives of a thickness of a finished yarn count, the hassle of handling yarns, and a paralleling facility. In addition, three to four ply yarn may be aligned in parallel when the yarn count is thin. The use of more than four ply yarn increases a burden including hassle and is therefore difficult to adopt. Next, the two or more paralleled single yarns are untwisted by a yarn twister. For example, in the case of a single yarn having been initially twisted in the Z direction, the paralleled yarn is untwisted by applying a subsequent twist in an opposite direction (the S direction) to the twist direction of the single yarn. While the number of subsequent twists at this point is not particularly restricted, the number of subsequent twists is to be appropriately adjusted depending on hand and a drop fluff property required by the towel cloth. As an example of the number of subsequent twists, when two single yarns are to be paralleled, untwisting the single yarns by applying subsequent twists so that the number (ratio) of subsequent twists is equivalent to 20 to 80% of the number of initial twists of the single yarns prior to paralleling enables advantageous effects of the present invention to be exhibited and is therefore preferable.

Figure 1A:
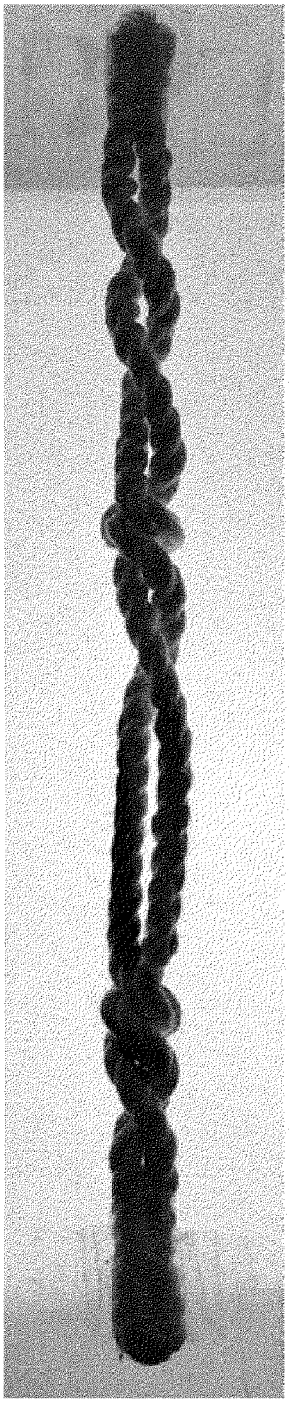
FIG. 1 presents enlarged photographs of a first embodiment of a twisted yarn using a thick string, in which (a) shows a twisted yarn in which a two ply yarn has been untwisted, (b) shows a aligned yarn in parallel according to a first comparative example, and (c) shows a twisted yarn in which a two ply yarn has been additionally twisted according to a second comparative example.
Figure 1B:
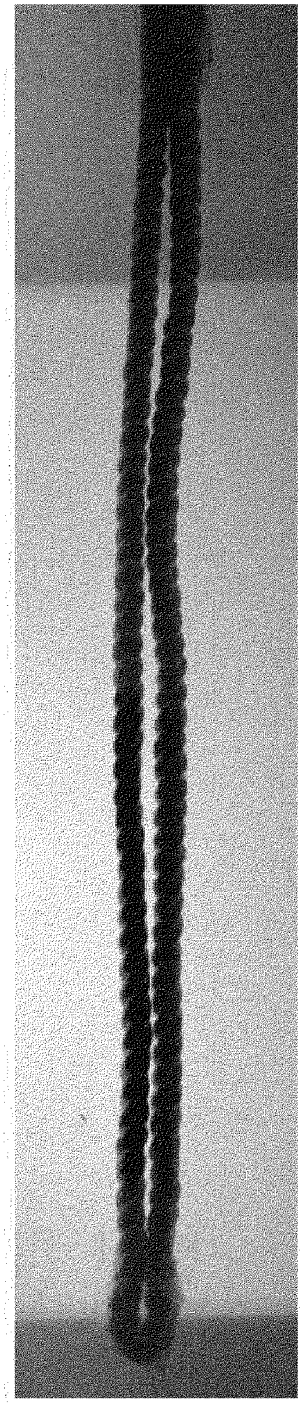
Figure 1C:
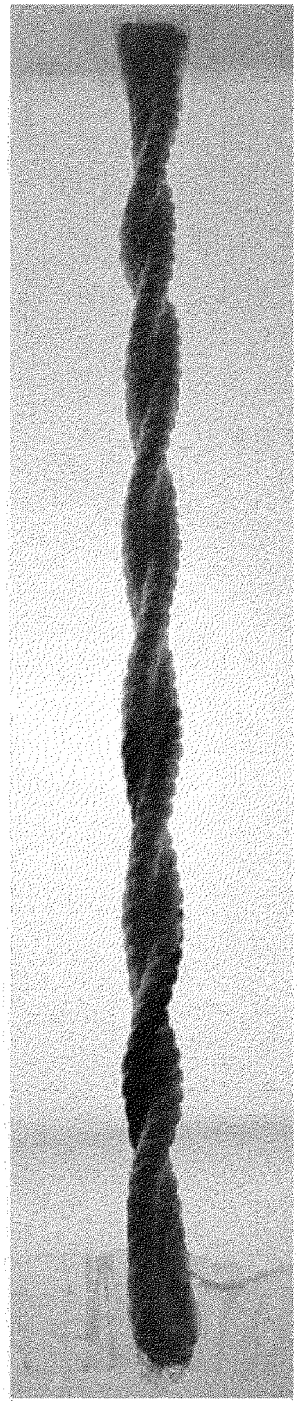

FIG. 1 presents enlarged photographs of the first embodiment of a twisted yarn using a thick string, in which (a) shows a twisted yarn in which a two ply yarn has been untwisted according to the first embodiment, (b) shows a paralleled yarn according to a first comparative example, and (c) shows a twisted yarn in which a two ply yarn has been additionally twisted according to a second comparative example. As single yarns of a pile yarn, two cotton strings with a diameter of 5.0 mm and a length of 23.6 cm which have been initially twisted 5.6 times/inch in the Z direction are prepared. After paralleling the two single yarns initially twisted in the Z direction, the two single yarns are untwisted together by applying, as a subsequent twist, four S-twists in an opposite direction to the single yarns (untwisting two ply yarn). In this case, FIG. 1(*a*) shows a photograph (microscope, manufactured by KEYENCE CORPORATION, 1.0 power magnification) of a twisted yarn subjected to a subsequent twist as described above taken by paralleling two single yarns and fixing both ends thereof with Sellotape (cellophane tape).

As a comparative example of the paralleled state, FIG. 1(*b*) shows a photograph of two single yarns, having been subjected to an initial Z twist, being simply paralleled (no subsequent twist) (first comparative example). This is a plain twofold yarn in which single yarns are simply paralleled. The two ply yarn is widely used as two ply yarn for towel cloth. In addition, FIG. 1(*c*) shows a photograph of a twisted yarn in which two ply yarn is additionally twisted together by applying, after paralleling two single yarns with an initial Z-twist, four subsequent twists of the same Z-twist as the single yarns (second comparative example). This is a tightly twisted, balanced yarn in which the additional twist is applied in a same direction as the Z-direction initial twist of the single yarns. Since the twist is tight, the yarn is known as a twisted yarn that produces hand with a cool contact feel and is often used in general woven/knitted fabrics and the like.

On the other hand, the twisted yarn being an untwisted two ply yarn according to the first embodiment exhibits an unprecedented unbalanced external appearance. There are several "accumulated twists" in which a twist portion of a two ply yarn is firmly fixed and hand is relatively hard at these locations. In addition, there are a large number of voids (gaps) between one accumulated twist and the next in which single yarns are separated from each other. The void between the single yarns is between binding points (accumulated twists) of the yarn, and since the void hardly collapses due to external force, the void is retained in a stable manner. Since the accumulated twists impart rigidity to the yarns as a whole, the twisted yarn structure described above provides a pile yarn with erectility and achieves superior so-called pile uprightness (erectility of pile). In addition, since an accumulated twist has fine irregularities on a surface thereof, using twisted yarn created by untwisting two ply yarn as a pile yarn produces towel cloth with a surface that is dry to the touch. Furthermore, the large number of voids between the single yarns include a lot of air and make yarns bulgy, and towel cloth using such yarns as pile yarns is bulky and realize fluffy hand. Moreover, the voids do not collapse readily and hand hardly changes even after washing.

Next, towel cloth using the twisted yarn according to the first embodiment will be described. Generally, towel cloth is constituted of a pile yarn and two ground yarns. The ground yarns are located at the center of the towel cloth, constituted of a warp ground yarn and a weft ground yarn, and grasp front and back pile yarns. The pile yarn is a vertical pile yarn having large loops on the front and back sides of a towel. Generally, a composition ratio of pile yarn and ground yarn of towel cloth is pile yarn: 65 to 80 wt. % and ground yarn: 35 to 20 wt. % and the pile yarn with the higher composition ratio is directly related to performance of the towel cloth such as hand and drop fluff property.

While a material of the pile yarn is not limited as long as the pile yarn is a staple spun yarn, 100% cotton yarn is preferably used due to superior hand, moisture absorbency, and water absorbability. A small amount of a material other than cotton such as rayon, cupra, acryl, wool, or polyester may be mixed with cotton. Rayon and cupra provide moisture absorbency, acryl and wool provide heat retention, and polyester provides dimensional stability and the like.

A used yarn count of the pile yarn is preferably 8 to 120 as a yarn count of a single pile yarn prior to paralleling. For example, 10 to 15 are favorable yarn counts for thick towel cloth, 20 to 40 are favorable yarn counts for medium thick towel cloth, and 48 to 100 are favorable yarn counts for thin towel cloth. A yarn count under 8 means that the yarn is too thick, producing hard hand which is not preferable. In addition, a yarn count over 120 results in excessively thin hand and insufficient strength which is not preferable.

Towel cloth using the twisted yarn according to the first embodiment is preferably towel cloth constituted such that a mixing ratio of cotton is 60 wt. % or higher. This is a mixing ratio which enables hand, water absorbability, and moisture absorbency of cotton to be satisfied and towel cloth in which pile yarn and ground yarns are all 100% cotton yarns is particularly preferable. Moreover, at a mixing ratio of under 40 wt. %, rayon or cupra may be used in the ground yarn in order to improve moisture absorbency or wool may be used in the ground yarn in order to produce warmth.

Towel cloth using the twisted yarn according to the first embodiment has a weight of 100 to 1000 g/m$^2$ which is a preferable range that enables effects of hand and drop fluff property to be exhibited. Examples of preferable specific applications of the weight of towel cloth include a face towel application for relatively thin towel cloth with a weight of 100 to 250 g/m$^2$. Towel cloth with a weight of 250 to 450 g/m$^2$ is preferably used in a general hand towel application. Towel cloth with a weight of 500 to 1000 g/m$^2$ is preferably used in thick applications such as a bath towel. Towel cloth with a weight under 100 g/m$^2$ is thin and insufficient in terms of bulkiness and towel cloth with a weight exceeding 1000 g/m$^2$ is too thick and too heavy and are therefore both not preferable.

(Application to Air Spun Yarn)

Applying air spinning yarn with high rigidity as the twisted yarn according to the first embodiment further enhances pile uprightness (erectility of pile) due to a synergistic effect with the accumulated twist structure of the twisted yarn according to the first embodiment and produces bulky towel cloth. In this case, air spinning yarn refers to a yarn spun by spinning staple cotton using air and is not particularly limited. Among air spinning yarns, a core-in-sheath air spinning yarn in which a center portion (core) of the spun yarn has 20 to 30% of a parallel fiber portion and an outer layer portion (sheath) has 80 to 70% such as that disclosed in Patent Document 6 is particularly preferable. Since parallel fibers constitute center portions of the yarn and provide rigidity, the pile has high pile erectility and pile uprightness (erectility of pile) is favorable. In addition, the air spinning yarn is structured to have less fluff than conventional ring spun yarn. Combining the air spinning yarn with the twisting of untwisted two ply yarn according to the first embodiment results in even more bulky hand and reduced drop fluff and therefore produces an optimal spun yarn. Further favorably, the air spinning yarn has superior water absorbability.

As described above, with twisted yarn created by untwisting two ply yarn according to the first embodiment, by adopting single air spinning yarn, paralleling two or more single yarns, and untwisting the yarns by a subsequent twist in an opposite direction to an initial twist direction of the single yarns, a void is created between an accumulated twist and a single yarn and favorable pile uprightness (erectility of pile), bulkiness, fluffy hand, and a dry touch are obtained. At the same time, drop fluff can be improved.

EXAMPLES

First, an evaluation method will be explained and, subsequently, three examples and evaluation results based on the evaluation method will be described.

[Evaluation Method]

(1) Evaluation of Twisted Yarn Used in Pile Yarn of Towel Cloth

A bulge of a strand of twisted yarn and an external appearance of fluff are photographed (the microscope described earlier, 200 power magnification). A thickness of the yarn is evaluated by measuring a yarn diameter (mm) at the 200 power magnification. The thicker the yarn, the higher the bulge and therefore favorable.

(2) Pile Uprightness (Erectility of Pile) of Towel Cloth: Evaluation of Pile Height Thickness (weft ground yarn) of a fabric made of finished towel cloth is photographed at 30 power by the microscope. A height of pile which correlates with pile uprightness (erectility of pile) of the fabric is evaluated from the photograph. A center line is drawn on a central portion (ground yarn portion) of the towel cloth, a height of pile protruding on both front and back surfaces is measured at 10 locations, and an average value thereof is evaluated as a pile height (mm) of the towel cloth. The larger the value, the larger the pile definition and the bulgier the hand and is therefore preferable.

(3) Evaluation of Bulkiness of Towel Cloth

Thickness is measured according to the method described in JIS L-1096 and evaluated based on bulkiness ($cm^3/g$) presented below.

$$\text{Bulkiness } (cm^3/g) = \text{thickness (mm)}/\text{weight } (g/m^2) \times 1000$$

Bulkiness is expressed as a volume per 1 g of toweling. The larger the value, the bulkier and, therefore, the more preferable the towel cloth. In addition, bulkiness is evaluated with respect to towel cloth after washing 30 times in addition to after washing 0 times to evaluate a change in bulkiness due to washing.

(4) Evaluation of Fluffy Hand of Towel Cloth

"Compression workload (WC) ($gf \cdot cm^2$)" disclosed in Non-Patent Document 1 is measured and evaluated. Using compression tester KES-FB3-A (manufactured by KATO TECH CO., LTD.), towel cloth is compressed at a constant speed to obtain a compression workload WC ($gf \cdot cm^2$) thereof. Measurements are taken at five locations and an average value thereof is presented. As described with reference to the relationship between hand and a physical quantity according to Non-Patent Document 1, fluffy feel has a strong correlation to compression workload. The measurement result indicates energy when fabric is compressed and the higher the value, the more readily the towel is compressed and the greater a bulge=fluffy feel.

(5) Evaluation of Dry Touch of Towel Cloth

Evaluation of the dry touch of the toweling is performed using the following four grades with respect to an average value of a sensory evaluation by touch of ten evaluators: dry to the touch and superior (A), good (B), normal (C), and poor (D).

(6) Evaluation of Drop Fluff Property Due to Washing of Towel Cloth

Drop fluff due to washing is evaluated according to the method described in JIS L-0217, 103. A drop fluff rate (%) is obtained according to the following equation, where the smaller the value, the smaller the amount of drop fluff and therefore favorable.

$$\text{Drop fluff rate } (\%) = (\text{weight of drop fluff after washing } (W)/(\text{weight of towel before washing } (W_0)) \times 100$$

(7) Evaluation of Drop Fluff by Sellotape (Cellophane Tape) of Towel Cloth

Drop fluff by Sellotape (cellophane tape) is evaluated according to a fluff adhesion test method of the QTEC test method (QTEC-NTM1). To summarize the test, Sellotape (cellophane tape) is attached to a lower part of a 4.0-Kpa heavy bob (weight), and an adhesive surface of the tape is brought into contact with a front surface of the towel cloth for a duration of 5 seconds. The tape is then peeled off from the towel cloth and a lack or abundance of fluff loss that is adhered to the tape is visually determined using the following five grades: grade 5 (no fluff loss, superior), grade 4 (minimal fluff loss, favorable), grade 3 (normal fluff loss), grade 2 (fluff loss present, poor), grade 1 (lot of fluff loss, inferior).

First Example (1) Manufacturing Method and Evaluation of-Towel Cloth

A. Twisting

Figure 2A:
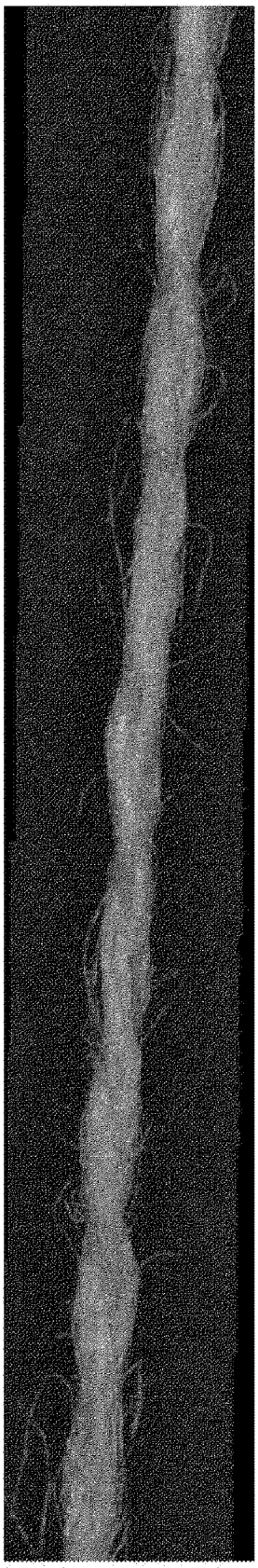
FIG. 2 presents enlarged photographs of a pile yarn according to a first example, in which (a) shows a twisted yarn in which a two ply air spinning yarn has been untwisted, (b) shows a yarn according to the first comparative example in which single yarns of air spinning yarn have been paralleled without untwisting the single yarns, and (c) shows a twisted yarn according to the second comparative example in which a two ply ring spun yarn has been untwisted.
Figure 2B:
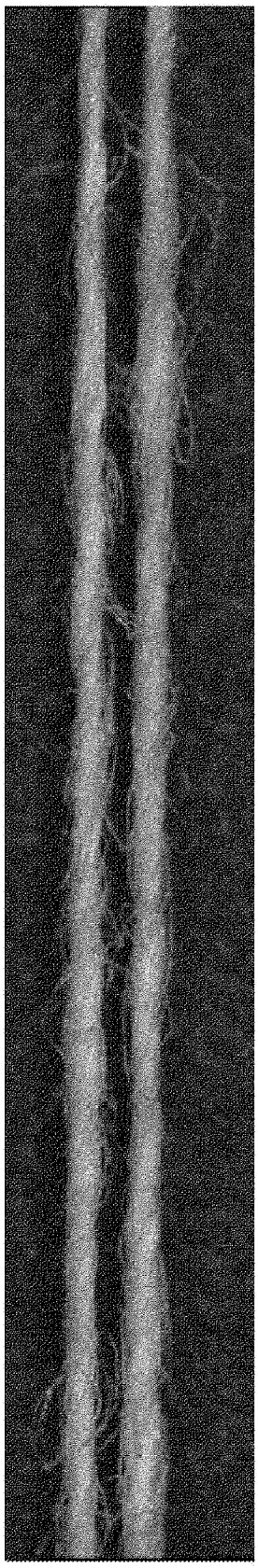
Figure 2C:
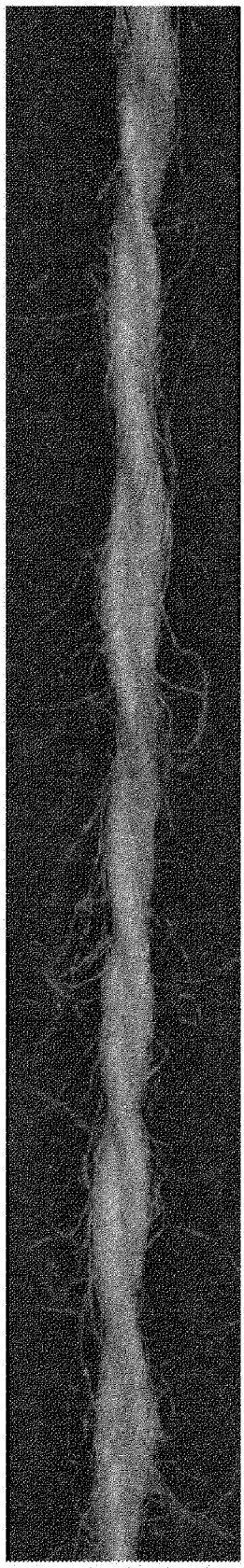

As pile yarn, a single yarn of a core-in-sheath air spinning yarn with a yarn count of 40 was prepared in which a center portion (core) of the spun yarn has 20 to 30% of a parallel fiber portion and an outer layer portion (sheath) has 80 to 70% and which had been twisted 18 times/inch by a Z-twist. Next, two of the initially twisted single yarns were paralleled and then untwisted by subsequently twisting the single yarns with a yarn twister in an S-twist in an opposite direction to the initial twist at 9 twists/inch (subsequent twist ratio: 50%). FIG. 2 presents enlarged photographs of the pile yarn according to the first example, in which (a) shows a twisted yarn in which a two ply air spinning yarn has been untwisted, (b) shows a yarn in which single yarns of air spinning yarn have been paralleled without untwisting the single yarns (first comparative example to be described later), and (c) shows a twisted yarn in which a two ply ring spun yarn has been untwisted (second comparative example to be described later). Based on the photograph shown in FIG. 2(*a*), a diameter of the yarn was measured and an external appearance of fluff was evaluated.

First Comparative Example

A single yarn of air spinning yarn was woven, processed, and finished in accordance with the first example with the exception of using yarn simply subjected to paralleling without being untwisted as a pile yarn. Thickness of the finished towel cloth was 3.80 mm and weight was 430 g/m$^2$. In addition, thickness after washing the finished towel cloth 30 times was 3.70 mm and weight was 430 g/m$^2$. An evaluation was performed in accordance with the first example of which a result is described in Table 1.

TABLE 1

| | Evaluation 1 Yarn thickness (mm) | Evaluation 2 Pile height (mm) | Evaluation 3 Bulkiness (cm$^3$/g) Parenthesized: after washing 30 times | Evaluation 4 Compression workload WC (gf · cm$^2$) | Evaluation 5 Dry touch | Evaluation 6 Drop fluff rate due to washing (%) | Evaluation 7 Fluff loss by cellophane tape (grade) |
|---|---|---|---|---|---|---|---|
| First example | 8 to 10 | 3.79 | 10.62 (10.21) | 4.68 | A | 0.0082 | 4 to 5 |
| First comparative example | 4 to 5 | 3.30 | 8.84 (8.60) | 3.80 | C | 0.0110 | 3 to 4 |
| Second comparative example | 8 to 10 | 2.53 | 7.30 (7.16) | 3.49 | C to D | 0.0307 | 2 |

Second Comparative Example

A single yarn was untwisted, woven, processed, and finished in a similar manner to the first example with the exception of using a single ring spun yarn with a yarn count of 40 and twisted in a Z-twist 18 times/inch. Thickness of the finished towel cloth was 3.03 mm and weight was 415 g/m$^2$. Thickness after washing the finished toweling 30 times was 2.97 mm and weight was 415 g/m$^2$. An evaluation was performed in accordance with the first example of which a result is described in Table 1.

B. Processing of Towel Fabric

Figure 3A:
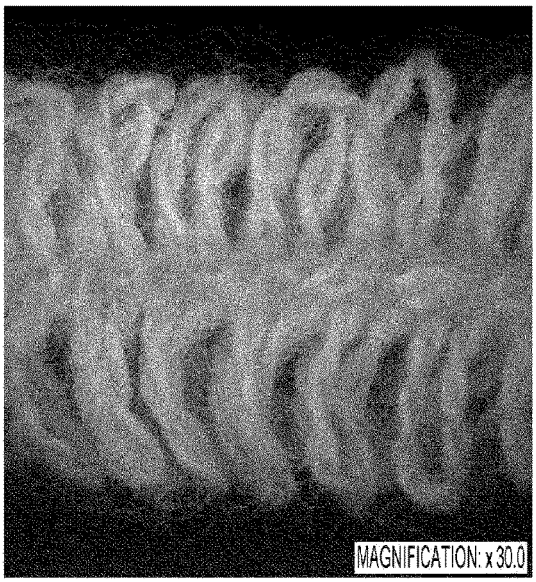
FIG. 3 presents enlarged photographs of a pile uprightness (erectility of pile) of a towel loom using the pile yarn according to the first example, in which (a) shows a pile uprightness of a towel loom using air spinning yarn, (b) shows a pile uprightness of a towel loom using the yarn according to the first comparative example in which single yarns of air spinning yarn have been aligned in parallel without untwisting the single yarns, and (c) shows a pile uprightness of a towel loom using the twisted yarn according to the second comparative example in which a two ply ring spun yarn has been untwisted.
Figure 3B:
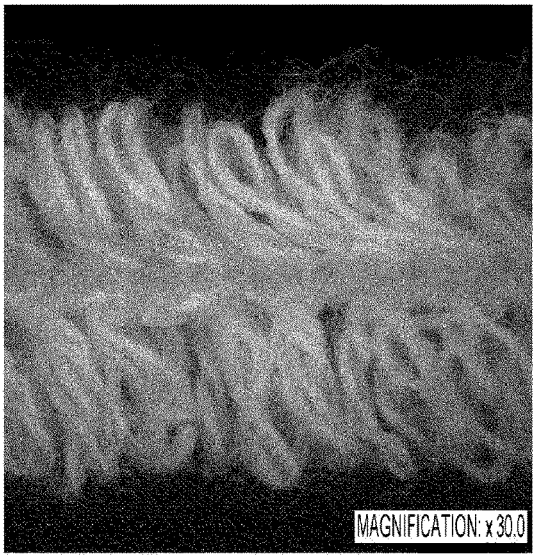
Figure 3C:
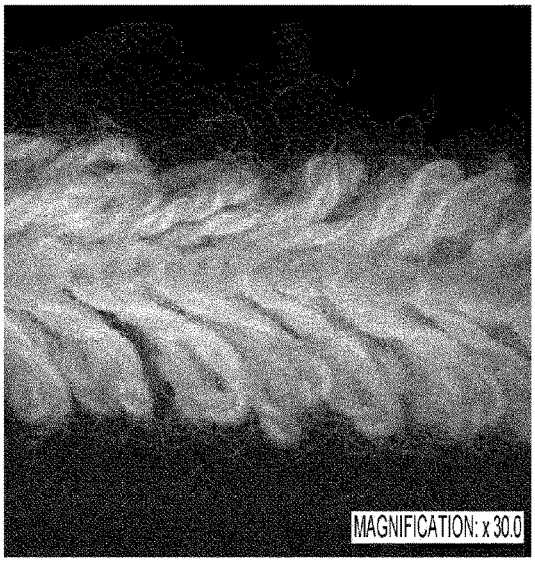
Figure 4A:
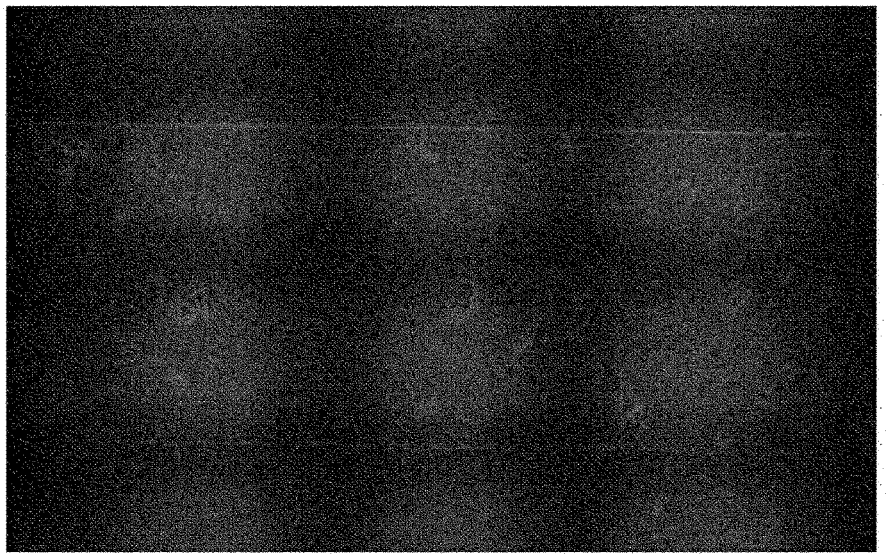
FIG. 4 presents photographs of fluff attached to Sellotape (a registered trademark) (cellophane tape) from towel cloth, in which (a) shows fluff loss of the towel loom using air spun yarn, (b) shows fuzz loss of the towel loom using the yarn according to the first comparative example in which single yarns of air spinning yarn have been aligned in parallel without untwisting the single yarns, and (c) shows fluff loss of the towel loom using the twisted yarn according to the second comparative example in which a two ply ring spun yarn has been untwisted.
Figure 4B:
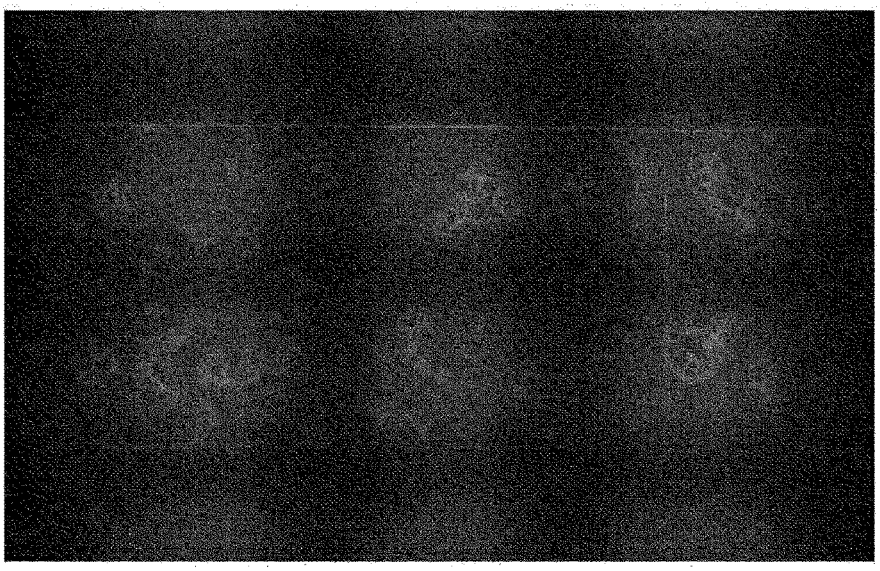
Figure 4C:
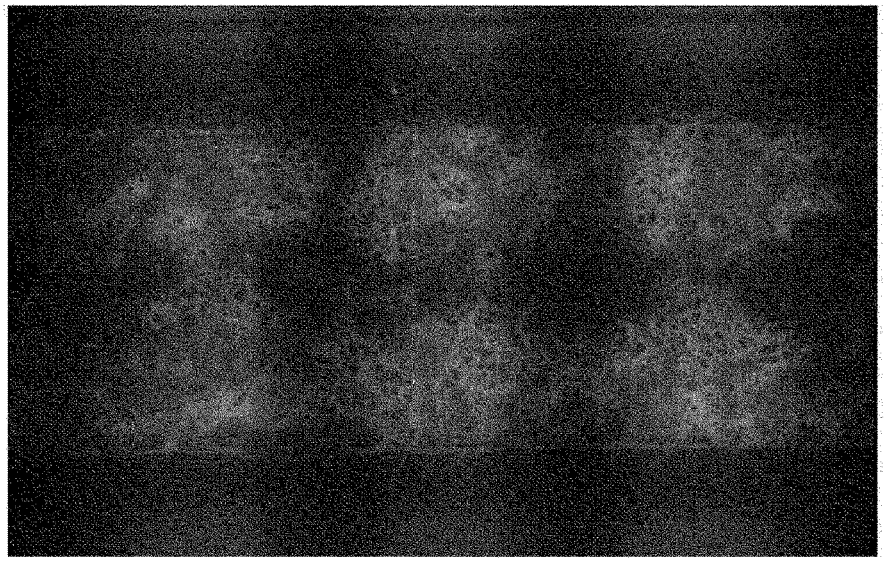

Next, a fabric was woven with a towel loom using the untwisted yarn count 40 two ply yarn as a warp pile yarn, a yarn count 24 two ply yarn of ring spun yarn as a warp ground yarn, and a yarn count 16 two ply yarn of ring spun yarn as a weft ground yarn. The woven fabric was finished by performing desizing and scouring, bleaching, and whitening with a fluorescent dye under normal processing conditions for cotton. FIG. 3 presents enlarged photographs of a pile uprightness (erectility of pile) of a towel loom using the pile yarn according to the first example, in which (a) shows a pile uprightness (erectility of pile) of a towel loom using air spinning yarn, (b) shows a pile definition uprightness (erectility of pile) of a towel loom using the yarn in which single yarns of air spinning yarn have been paralleled without untwisting the single yarns (first comparative example), and (c) shows a pile uprightness (erectility of pile) of a towel loom using the twisted yarn in which a two ply ring spun yarn has been untwisted (second comparative example). FIG. 4 presents photographs of fluff attached to Sellotape (cellophane tape) from towel cloth using the pile yarn according to the first example, in which (a) shows fluff loss of the towel loom using air-spinning yarn, (b) shows fluff loss of the towel loom using the yarn in which single yarns of air spinning yarn have been paralleled without untwisting the single yarns (first comparative example), and (c) shows fluff loss of the towel loom using the twisted yarn in which a two ply ring spun yarn has been untwisted (second comparative example). Thickness of the finished towel cloth was 4.64 mm and weight was 437 g/m$^2$. In addition, thickness after washing the finished towel cloth 30 times was 4.46 mm and weight was 437 g/m$^2$. In accordance with the measurement method described above, a height of the pile yarn of the towel cloth bulkiness, a physical quantity of fluffy hand, dry touch, epilation property, and fluff loss were evaluated.

(2) Evaluation Result

A. Evaluation of Twisted Yarn

As is apparent from the twisted yarn photograph (200 power magnification) in FIG. 2(*a*) according to the first example, the yarn according to the first example is thick (the yarn has a diameter of 8 to 10 mm in the 200-power enlarged photograph), bulgy, and only a small amount of fluff. The yarn had an extremely preferable external appearance as a pile yarn. On the other hand, the first comparative example shown in FIG. 2(*b*) is a yarn which is created by paralleling two single yarns and which has a small amount of fluff of the single yarns, which is narrow (the yarn has a diameter of 4 to 5 mm in the enlarged photograph), and only a small bulge. In addition, although the second comparative example shown in FIG. 2(*c*) provides a thick yarn (the yarn has a diameter of 8 to 10 mm in the enlarged photograph), the yarn has a large amount of long fluff.

B. Evaluation of Towel Fabric

As is apparent from Table 1, the towel cloth according to the first example is excellent towel cloth with a good pile uprightness (erectility of pile), superior bulkiness, fluffy hand, dry to the touch, and low fluff loss. More specifically, the pile height was 3.79 mm which is a 15% increase from the first comparative example and a 49.8% increase from the second comparative example. In a similar manner, bulkiness was 10.62 cm$^3$/g which is a significant increase by a factor of 1.2 to 1.5 and compression workload was 4.68 gf·cm$^2$ which is also a significant increase by 23% to 34% with respect to the first and second comparative examples. The dry touch corresponded to a highest level in terms of sensory evaluation. In addition, the rate of drop fluff due to washing was lower by 25% to 73%. Fluff loss due to a Sellotape (cellophane tape) was Grades 4 to 5 which indicate that the towel cloth is least susceptible to fluff loss. Bulkiness after washing 30 times is 10.21 cm$^3$/g which is almost unchanged from prior to the washing and a bulky, fluffy hand was maintained even after washing. Furthermore, with respect to water absorbability, as a result of dripping about 0.7 ml of water to the surface of a towel using a dropper on hand, it was found that the water was absorbed at a rate of 1 second or less and that the towel has superior water absorbability.

The finished towel was woven into a hand towel and a practical trial was performed. First, the bulky and fluffy hand was pleasant and generated plenty of a luxurious feel. In addition, after sweating, the towel did not become sticky and was dry to the touch and pleasantly sweat-absorbent. Furthermore, there was hardly any drop fluff from the towel when washed and fluff was not transferred to other clothes, making the hand towel extremely pleasant.

On the other hand, the first comparative example is inferior overall to the first example and particularly inferior with respect to bulkiness, fluffy hand, and dry touch. The second comparative example is considerably inferior overall and, in particular, inferior in terms of bulky hand, dry touch, drop fluff property, and fluff loss.

Second Example

As pile yarn, a single yarn of a core-in-sheath air spinning yarn with a yarn count of 24 according to the first example was prepared which had been twisted 13 times/inch by a Z-twist. Next, two of the initially twisted single yarns were paralleled and then untwisted by subsequently twisting the single yarns with a yarn twister in an S-twist in an opposite direction to the single yarns at 6 twists/inch (subsequent twist ratio: 46%). The fabric was desized and scoured, bleached, and finished according to the first example with the exception of being woven into a fabric using the untwisted yarn count 24 two ply yarn as a warp pile yarn, a yarn count 20 two ply yarn of ring spun yarn as a warp ground yarn, and a yarn count 14 two ply yarn of ring spun yarn as a weft ground yarn. Thickness of the finished towel cloth was 5.98 mm, weight was 572 g/m$^2$, and bulkiness was 10.45 (cm$^3$/g). The towel cloth was stitched into a bath towel to be worn. Hand of the worn towel was bulky and extremely fluffy. In addition, when used after taking a bath, the pleasant blue towel was dry to the touch and had good water absorbability. Furthermore, even when washed, there was hardly any transfer of fluff from the comfortable towel to other clothes. Moreover, the initial bulkiness, fluffy hand, and dryness to the touch were hardly diminished due to washing and the towel with hand was durable.

Third Example

As pile yarn, a single yarn of a core-in-sheath air spinning yarn with a yarn count of 80 according to the first example was prepared which had been twisted 25 times/inch by a Z-twist. Next, two of the initially twisted single yarns were paralleled and then untwisted by subsequently twisting the single yarns with a yarn twister in an S-twist in an opposite direction to the single yarns at 12 twists/inch (subsequent twist ratio: 48%). The fabric was desized and scoured, bleached, and finished according to the first example with the exception of being woven into a fabric using the untwisted number 80 two ply yarn as a warp pile yarn, a number 30 two ply yarn of ring spun yarn as a warp ground yarn, and a yarn count 18 two ply yarn of ring spun yarn as a weft ground yarn. The finished towel cloth had a large pile uprightness (erectility of pile) and thickness was 3.21 mm, weight was 305 g/m$^2$, and bulkiness was 10.52 (cm$^3$/g). The towel cloth was then stitched into a face towel to be worn. Hand of the worn towel was thin but bulky and extremely soft and fluffy. In addition, the towel was dry to the touch after washing the face and had a good wiping feel. Furthermore, there was hardly any drop fluff and transfer of fluff from the face towel to other clothes due to washing and the face towel had excellent wearability. Moreover, hand hardly changed due to washing and the face towel was usable over a long period of time.

As described above, the present invention enables towel cloth to be obtained which has favorable pile uprightness (erectility of pile) and bulkiness, and has both a fluffy hand and a dry touch, and moreover which hardly drops fluff which were not obtainable by conventional art.

First Aspect:

Towel cloth constituted by locking a pile yarn to a ground yarn, wherein the pile yarn has two or more single yarns initially twisted in a same direction, and the pile yarn is structured such that the two or more single yarns are integrally twisted in an opposite direction to the initial twist.

Second Aspect:

The towel cloth according to the first aspect, wherein the single yarn is constituted of air spinning yarn.

Third Aspect:

The towel cloth according to the first or second aspect, wherein a yarn count of the single yarn is 8 to 120.

Fourth Aspect:

The towel cloth according to any one of first to third aspects, wherein the single yarn is constituted of cotton at a mixing ratio of 60 wt. % or higher.

Fifth Aspect:

The towel cloth according to any one of first to fourth aspects, wherein weight is 100 to 1000 g/m$^2$.

Sixth Aspect:

A manufacturing method of towel cloth constituted by locking a pile yarn to a ground yarn, the manufacturing method of towel cloth including the steps of:

paralleling two or more single yarns initially twisted in a same direction;

untwisting the two or more single yarns by a subsequent twist in an opposite direction to the initial twist and forming a pile yarn; and locking the pile yarn to a ground yarn in which a warp ground yarn and a weft ground yarn intersect each other.

What is claimed is:

1. Towel cloth constituted by locking pile yarns to a ground yarn, wherein each of the pile yarns consists of two paralleled air-spun single yarns of 100% cotton, each air-spun single yarn being initially twisted in the same first direction, and each of the pile yarns is structured such that the two paralleled air-spun single yarns are integrally twisted in a second direction opposite to the first direction, wherein a number of integral twists in the second direction ranges from 20% to 80% of a number of initial twists in the first direction such that the pile yarns comprise a plurality of accumulated twists and voids located between the two paralleled air-spun single yarns, the voids being located between respective accumulated twists.

2. The towel cloth according to claim 1, wherein a yarn count of the two paralleled air-spun single yarns is 8 to 120.

3. The towel cloth according to claim 1, wherein a basis weight of the towel cloth is 100 to 1000 g/m$^2$.

4. A manufacturing method of towel cloth constituted by locking pile yarns, the method comprising:

a step of paralleling two air-spun single yarns of 100% cotton yarn, each air-spun single yarn being a fiber initially twisted in the same first direction;

a step of untwisting the two paralleled air-spun single yarns by a subsequent twist in a second direction opposite to the first direction of the initial twist to form the pile yarn, wherein a number of integral twists in the second direction ranges from 20% to 80% of a number of initial twists in the first direction such that the pile yarns comprise a plurality of accumulated twists and voids located between the two paralleled air-spun single yarns, the voids being located between respective accumulated twists; and a step of locking the pile yarns to a ground yarn in which a warp ground yarn and a weft ground yarn intersect each other.

5. The towel cloth according to claim 2, wherein a basis weight of the towel cloth is 100 to 1000 $g/m^2$.

6. The towel cloth according to claim 1, wherein a basis weight of the towel cloth is 100 to 1000 $g/m^2$.

7. The towel cloth according to claim 1, wherein the number of integral twists in the second direction ranges from 46% to 50% of the number of initial twists in the first direction.

8. The towel cloth according to claim 1, wherein each of the two paralleled air-spun single yarns is a core-in-sheath air spun yarn in which a core of the air-spun single yarn is a parallel fiber portion constituting 20% to 30% of the air-spun single yarn.

* * * * *